United States Patent [19]

Canham

[11] Patent Number: 4,508,410

[45] Date of Patent: Apr. 2, 1985

[54] ELECTRICAL TERMINATION SYSTEM AND CONNECTOR MEMBER

[75] Inventor: Kevin Canham, Newmarket, England

[73] Assignee: Allied Corporation, Morris Township, Morris County, N.J.

[21] Appl. No.: 442,335

[22] Filed: Nov. 17, 1982

[30] Foreign Application Priority Data

Dec. 1, 1981 [GB] United Kingdom ..... 8136246

[51] Int. Cl.[3] ..... H01R 13/38

[52] U.S. Cl. ..... 339/99 R; 339/103 M

[58] Field of Search ..... 339/97 R, 97 P, 98, 339/99 R, 101, 103

[56] References Cited

U.S. PATENT DOCUMENTS

| | | | |
|---|---|---|---|
| 2,344,766 | 3/1944 | Deakin | 339/99 R |
| 3,154,363 | 10/1964 | Will | 339/99 R |
| 3,731,254 | 5/1984 | Key | 339/17 |
| 3,760,335 | 9/1973 | Roberts | 339/99 |
| 3,824,530 | 7/1974 | Roberts et al. | 339/99 |
| 3,864,011 | 2/1975 | Huber | 339/103 |
| 3,953,096 | 4/1976 | Williams | 339/17 |
| 3,963,319 | 6/1976 | Schumacher et al. | 339/176 |
| 4,002,395 | 1/1977 | Wilson | 339/99 R |
| 4,017,135 | 4/1977 | Taguchi | 339/17 |
| 4,035,050 | 7/1977 | Volinskie | 339/99 |
| 4,047,785 | 9/1977 | Jayne | 339/99 |
| 4,071,696 | 1/1978 | Anderson | 179/1 |
| 4,083,615 | 4/1978 | Volinskie | 339/17 |
| 4,099,819 | 7/1978 | Keglewitsch | 339/75 |
| 4,103,985 | 8/1978 | Krolak et al. | 339/126 |
| 4,111,518 | 9/1978 | Zurcher | 339/252 |
| 4,148,540 | 4/1979 | Hayes | 339/99 R |
| 4,153,326 | 5/1979 | Frantz et al. | 339/99 |
| 4,153,327 | 5/1979 | Johnson | 339/205 |
| 4,159,158 | 6/1979 | Weidler | 339/97 |
| 4,190,952 | 3/1980 | Thomas et al. | 29/629 |
| 4,193,654 | 3/1980 | Hughes et al. | 339/17 |
| 4,193,658 | 3/1980 | Dittmann et al. | 339/97 |
| 4,202,593 | 5/1980 | Abernethy et al. | 339/125 |
| 4,225,209 | 9/1980 | Hughes | 339/126 |
| 4,231,628 | 11/1980 | Hughes et al. | 339/17 |
| 4,239,316 | 12/1980 | Spaulding | 339/91 |
| 4,239,317 | 12/1980 | Hesse et al. | 339/91 |
| 4,241,970 | 12/1980 | Rider, Jr. et al. | 339/99 |
| 4,241,974 | 12/1980 | Hardesty | 339/154 |
| 4,261,633 | 4/1981 | Abernethy | 339/97 |
| 4,286,835 | 9/1981 | Adams et al. | 339/17 |
| 4,296,991 | 10/1981 | Hughes et al. | 339/176 |

FOREIGN PATENT DOCUMENTS

| | | | |
|---|---|---|---|
| 0009867 | 5/1978 | European Pat. Off. . | |
| 0002367 | 6/1979 | European Pat. Off. . | |
| 0011923 | 6/1980 | European Pat. Off. . | |
| 0016507 | 10/1980 | European Pat. Off. . | |
| 0039569 | 4/1981 | European Pat. Off. . | |
| 0039978 | 11/1981 | European Pat. Off. . | |
| 2852599 | 6/1979 | Fed. Rep. of Germany | 339/99 R |
| U576169 | 1/1982 | Japan . | |
| 1151088 | 9/1966 | United Kingdom . | |
| 1295059 | 12/1969 | United Kingdom . | |
| 1330340 | 12/1970 | United Kingdom . | |
| 1215497 | 12/1970 | United Kingdom . | |
| 1223430 | 2/1971 | United Kingdom . | |
| 1351865 | 4/1971 | United Kingdom . | |
| 1293970 | 4/1971 | United Kingdom . | |
| 1297494 | 8/1971 | United Kingdom . | |
| 1373138 | 12/1971 | United Kingdom . | |
| 1440813 | 7/1973 | United Kingdom . | |
| 1434860 | 3/1974 | United Kingdom . | |
| 1491694 | 12/1974 | United Kingdom . | |
| 1401383 | 7/1975 | United Kingdom . | |
| 1528971 | 7/1976 | United Kingdom . | |
| 1513105 | 8/1976 | United Kingdom . | |
| 1497629 | 10/1976 | United Kingdom . | |
| 1544919 | 11/1976 | United Kingdom . | |
| 1536636 | 11/1976 | United Kingdom . | |
| 1525363 | 1/1977 | United Kingdom . | |
| 1476649 | 6/1977 | United Kingdom . | |
| 1555393 | 7/1977 | United Kingdom . | |
| 1535159 | 7/1977 | United Kingdom . | |
| 2008336 | 5/1979 | United Kingdom . | |
| 2013991 | 8/1979 | United Kingdom . | |
| 2013994 | 8/1979 | United Kingdom . | |
| 2013044 | 8/1979 | United Kingdom . | |
| 2030380 | 4/1980 | United Kingdom . | |
| 2034538 | 6/1980 | United Kingdom . | |
| 2037499 | 7/1980 | United Kingdom . | |
| 1585807 | 3/1981 | United Kingdom . | |

*Primary Examiner*—Joseph H. McGlynn
*Attorney, Agent, or Firm*—Roger H. Criss

[57] ABSTRACT

An electrical connector socket, preferably for a telephone line jack, which includes a body, cover plate and contact members. The contact members have an insulation displacement contact at one end and a flexible contact at the other end. The contact members include a first bent portion received in a recess in a wall member of the body and a second bent portion closely conforming around an edge of the wall member. The cover plate is adapted to receive conductors, such as a ribbon cable, and terminate the conductors to the insulation displacement contacts when the cover plate is inserted into the body.

13 Claims, 10 Drawing Figures

ELECTRICAL TERMINATION SYSTEM AND CONNECTOR MEMBER

This invention relates to an electrical termination system for electrical conductors and to an electrical connector member.

Many problems still remain in the field of electrical connection. A first problem arises where there is a need to make connection between a plurality of electrical conductors and a corresponding plurality of electrical contact members. While this can readily be achieved in an assembly shop or the like where controlled conditions and sophisticated and complex equipment is available, it becomes much more difficult in the field, such as may be the case in telecommunication applications for example. Existing conventional telephone terminations at least in the United Kingdom either use solder contacts or use screw-type contacts, neither of which are quick or particularly easy to use.

Another problem arises in the construction and assembly of the electrical connector. Many connector members are formed of a considerable number of different parts in order to retain the contact members securely in the connector member while enabling electrical termination onto the contact member and permitting the contact member to contact another associated contact member. The construction and assembly of the connector members is complex and costly.

SUMMARY OF THE INVENTION

In accordance with this invention, there is provided a termination system for electrical conductors comprising:

a first insulative member having a first surface;

a plurality of conductive insulation—displacement contacts extending away from the first surface;

a second insulative member adapted to be opposed against the first surface on the first insulative member;

a second surface on the second insulative member and facing the first surface when the members are opposed to each other;

the first and second members being relatively moveable towards one another such that conductors located across the second surface on the second member can be forced into the insulation-displacement contacts on the first member; and means provided on the second member on opposed edge portions of the second surface and being capable of receiving, gripping and retaining conductors lying across the second surface prior to engagement with the contacts.

A preferred electrical connector socket, described in more detail below, is designed for use with a telephone line jack. The socket principally comprises an insulative body, a cover plate, and contact members. Each contact member has an insulation-displacement contact at one end and a flexible contact at the other for contacting a plug accommodated in the socket. The contact member is formed of a strip and has two bent portions. A first bent portion near the ID contact is accommodated in a recess in a wall section of the body. The second bent portion is around the end of the wall section and is a bend of between 90° and 180°. In this way the contact member is secured in position by its own resilience on the wall section without the need for separate fixing structure. Assembly is therefore greatly simplified.

The socket cover plate is used to push the conductors to be connected to the socket onto the ID contacts. A ribbon cable can be placed onto the operative surface of the cover plate and pushed straight onto the ID contacts. If individual conductors are being terminated, the wires are in turn forced into retaining means formed at the front and rear edges of the cover plate. Each wire is thus held fixed in position across the plate while the subsequent wires are positioned. Nevertheless the retaining structure does not interfere with the use of a ribbon cable.

Several sockets of this construction can be connected in parallel onto a ribbon cable without cutting the cable. This is achievable because the cover plate permits both runs of the cable to leave the socket. Thus the cable can be threaded in daisy chain arrangement through a plurality of sockets without being severed.

BRIEF DESCRIPTION OF THE DRAWINGS

The invention will now be described in more detail, by way of example, with reference to the drawings, in which.

DESCRIPTION OF THE PREFERRED EMBODIMENTS

Referring first to FIGS. 1 to 5 of the drawings, the basic construction of the electrical socket illustrated will be described. The socket is a 6 way socket designed to connect with a plug, shown in FIG. 10, and to terminate electrical conductors such as telephone wires.

Figure 10:
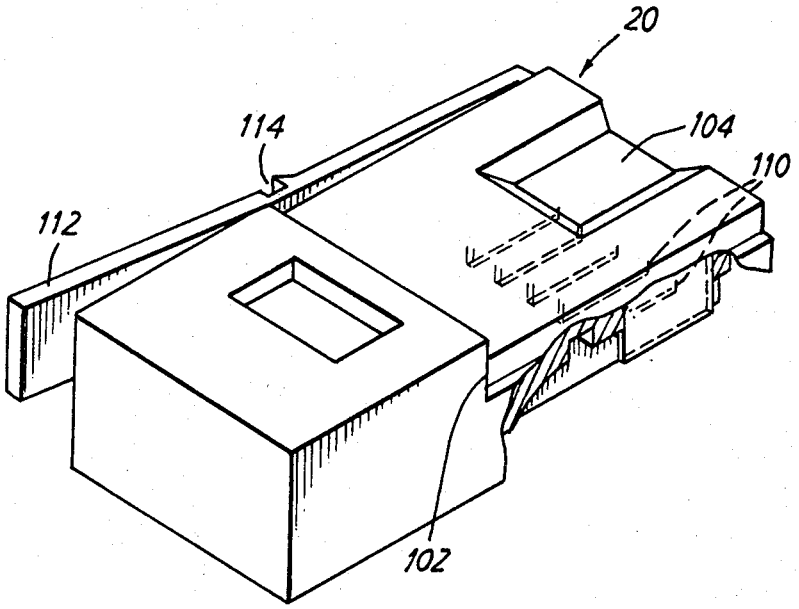
FIG. 10 shows a plug for use with the socket.

The socket comprises a moulded housing 10 of insulative plastics material such as an A.B.S. plastic, a cable holder and cover plate 12 received on the housing 10 and of similar material, and six contact members 14 retained in the housing 10. The housing 10 is of generally rectangular shape, and to give some idea of size is typically about 15 mm in height and length and about 18 mm in width. The housing has an aperture 16 extending from its front face 18 and which receives a modular plug 20 such as shown in FIG. 10.

Figure 1:
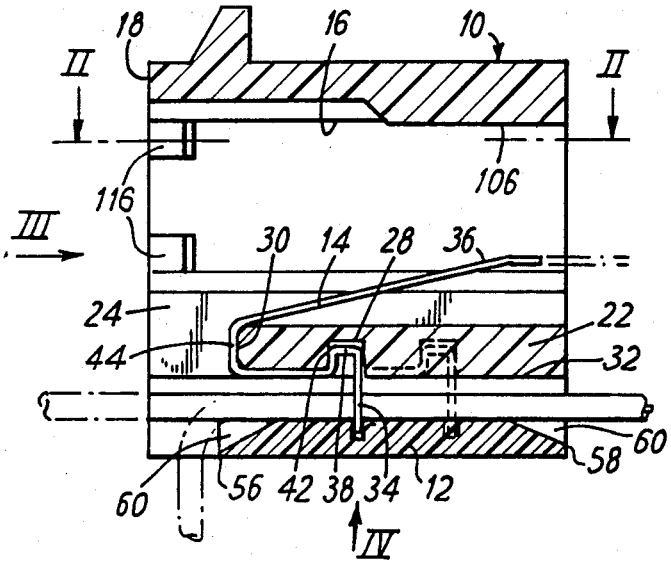
FIG. 1 is a side sectional view through an electrical socket connector embodying the invention.
Figure 2:
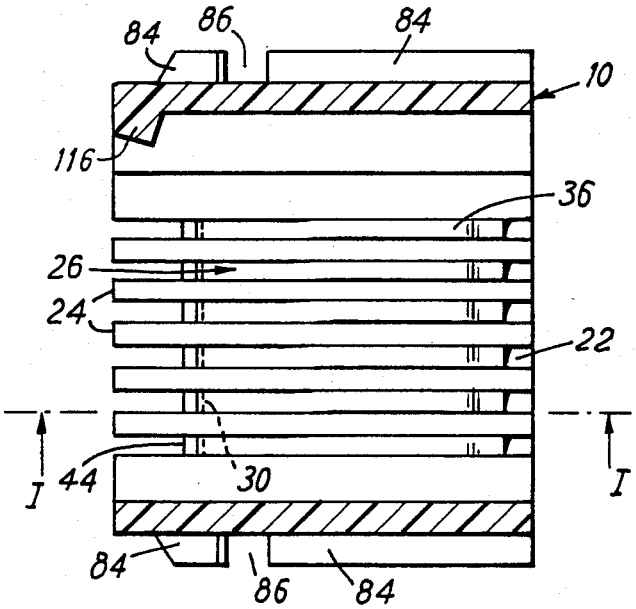
FIG. 2 is a sectional plan view taken on the line II—II on FIG. 1.
Figure 3:
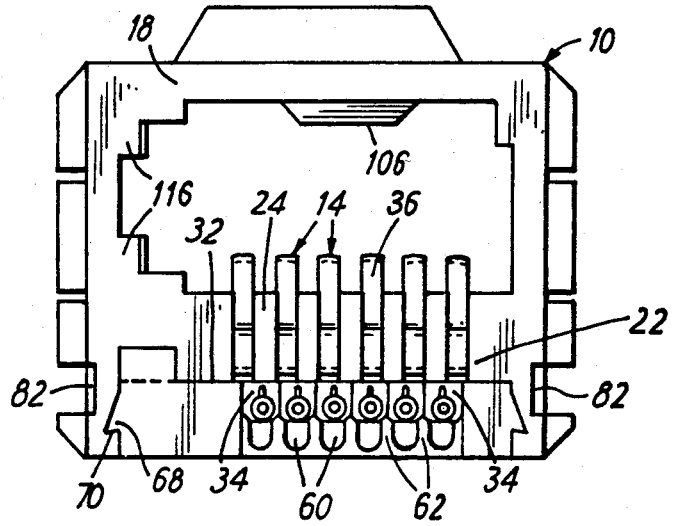
FIG. 3 is a front elevational view of the socket taken on the arrow III in FIG. 1.
Figure 4:
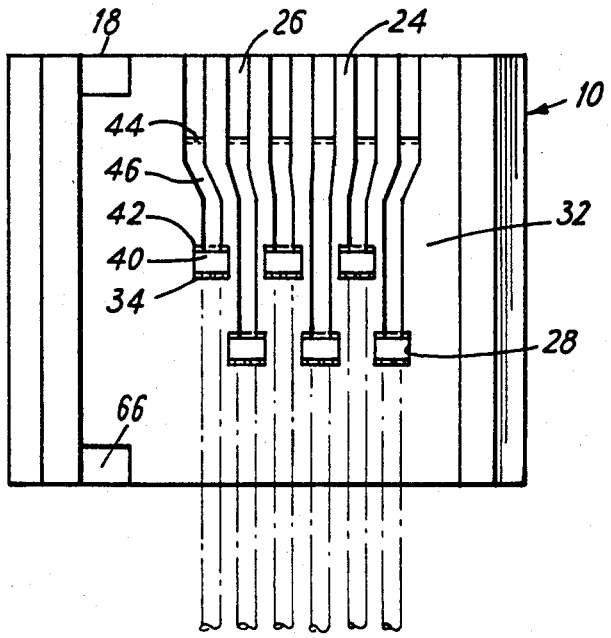
FIG. 4 is an underplan view of the socket taken on the arrow IV in FIG. 1 but with the cable holder and cover member removed.

The bottom of the aperture 16 is defined by a wall section 22 which is essentially in the form of a thick plate as shown in FIG. 1. The wall section 22 carries ribs 24 which extend the full front-to-back depth of the socket and are thicker than the wall section 22 so as to provide channels 26 extending around at least the top and front edge of the wall section 22. The lower surface of the wall section carries six recesses 28 in its bottom surface 32 and which are staggered into two lines as shown in FIG. 4 and indicated in dashed outline in FIG. 1. The front edge 30 of the wall section 22 is set back from the front 18 of the socket.

Each individual contact member 14 is formed from a phosphor-bronze strip and has an insulation-displacement ID contact 34 at one end which extends downwardly away from the bottom surface 32 of the wall section 22. The other end of each contact member 14 forms a flexible contact 36 for mating with a corresponding contact on the plug 20. The flexible contact 36 may be gold plated on part of its upper contacting surface. Between its two ends the contact member has two bent portions. In a first bent portion 38 adjacent the ID contact 34 the strip is bent through 180° and then back through 90°, thereby forming a box-section locating portion which is closely accommodate within the front and rear sides of the recess 28 and in particular has a face 40 which bears against the side 42 of the recess which is towards the edge 30 of the wall section 22. The next section of the contact member 14 then conforms to the bottom surface 32 of the wall section 22 and leads into a second bent portion 44 where the contact member is bent through an angle of between 90° and 180° and preferably between 135° and 180° so as to closely conform to the shape of the front edge 30 of the wall section 22. In this way the contact member is held onto the wall section by its resilience due to gripping contact between the bent portion 44, where it contacts the upper part of the front edge 30 and curves round towards the top surface of the wall section, and the bent portion 38, received in the recess 28.

The side-by-side spacing of the flexible contacts 36 is defined by the corresponding spacing on the associated plug. It may be desired to use the socket with a ribbon cable where the side-by-side spacing of the conductors is less than that of the flexible contacts. For this purpose the contact members are stepped, as at 46, to change the spacing between the flexible contacts 36 and the ID contacts 34. The side-by-side spacing of the six ID contacts would then be too small to allow the ID contacts to be formed properly; hence they are staggered alternately, as shown in FIG. 4.

Figure 5:
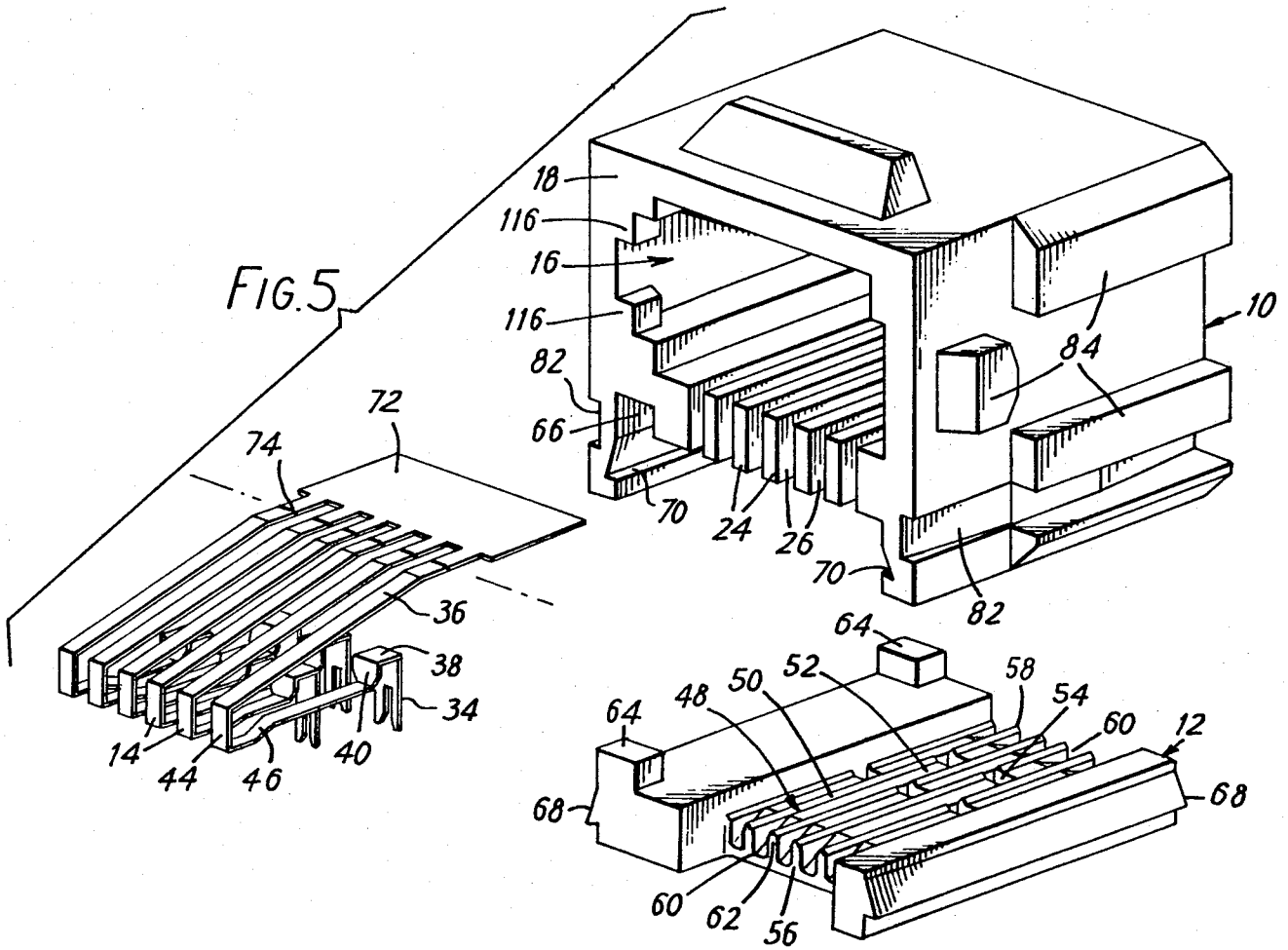
FIG. 5 is a perspective view of the socket prior to assembly.

The cable holder and cover plate 12 is designed to receive the cable and for this purpose the major part of its effective upper surface 48 carries small ridges 50 defining six groove portions 52 between them, as best seen in FIG. 5. The surface 48 also has six cavities or recesses 54 for receiving the respective insulation displacement contacts 34 which extend from the surface 32 of wall section 22. The front edge 56 of the surface 48 does not extend up to the front 18 of the socket, but is get back therefrom. The front edge 56 and the opposed rear edge 58 are specially shaped to provide slots 60 extending downwardly at an acute angle to the surface 48 and defined between upstanding ribs 62 which are continuations of the ridges 50.

The cable holder and cover plate 12 also has location pieces 64 which fit in recesses 66 on the housing 10 and prevent incorrect orientation of the cable holder and cover plate on the housing. The cable holder and cover plate 12 carries elongate locking sections or detents 68 on its two opposed side edges which are received and retained by two corresponding sections 70 on the housing 10. The plate 12 is thus a snap fit onto the housing 10.

The method of assembly of the contact members 14 into the housing will now be described. As seen from FIG. 5, the six contact members are mounted from a single carrier strip 72. The contact members are in fact formed originally from a flat sheet which is stamped and bent to produce the desired contact shape as shown in FIG. 5. The strip of contacts can be produced essentially continuously so that each group of six contacts is broken off as required. All this makes handling the small contacts very much easier.

The group of six contacts on the carrier strip is then inserted into the aperture 16 in the front face 18 of the housing 10 so that the contact members 14 align with the channels 26 in the wall section 22. The strip is pulled through from the rear of the housing and this forces the contact members around the wall section 22 until the bent portion 38 of each contact member snaps into the recess 28, thereby retaining the contact member in position in the housing. The contact members 14 are provided with thinned break sections 74 so that a quick up and down twist of the carrier strip 72 will sever it from the contact members, leaving the individual contact members in position.

It will be appreciated that this method of assembly and retention of the contact members in the housing is particularly simple both from the point of view of the construction of the component parts and especially their assembly.

It also has the flexibility to accommodate 4 way as an alternative to 6 way connection. If only four contacts are required then the carrier strip 72 is provided with contact members in groups of four, the outer contact members being omitted.

Figure 6:
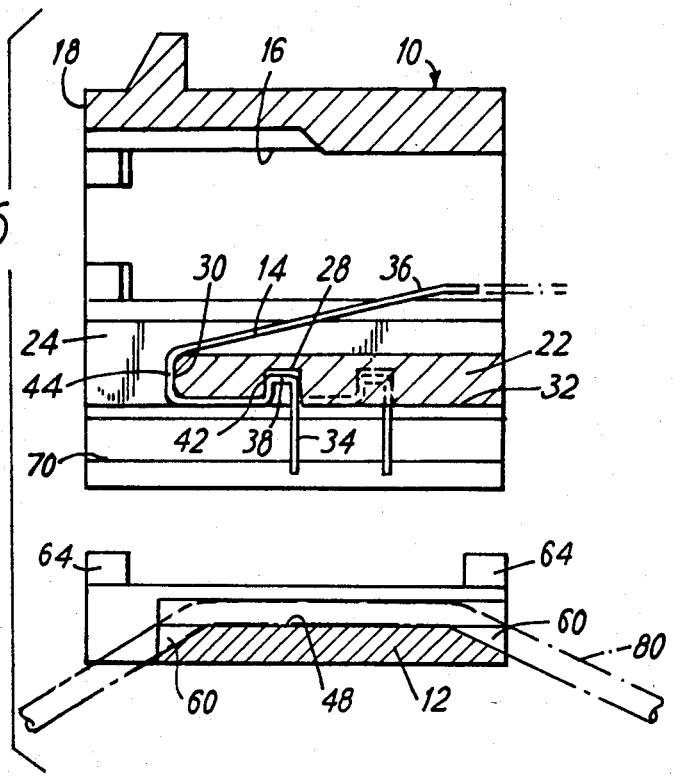
FIG. 6 is a side sectional view similar to FIG. 1 illustrating the assembly operation.

For use in the field therefore the socket now consists of two parts, namely the housing 10 complete with the contact members 14, and the cable holder and cover plate 12. These are seen in FIG. 6. The socket is designed to terminate either a ribbon cable, having six conductors side by side secured together by their insulation, or six individual insulated conductors of standard size. With a ribbon cable, the cable can easily be located on the surface 48 of the plate 12 with the individual conductors aligned with the grooves 52, while the plate is forced upwardly into mating engagement with the housing 10. During this movement, the cable will be forced onto the insulation-displacement contacts 34 which are shaped to penetrate the insulation and cut into and thus make electrical contact with the respective aligned conductors in the cable.

When used with six individual conductors the insulated conductors are placed in turn in the respective ones of the grooves 52. As each conductor 80 is located in its groove it is pulled down into the slanting slots 60 at the front and rear ends of the surface 48, as illustrated in FIG. 6. The diameter of the wire and the widths of the slots are related so that the wires are a tight fit in the slots and each wire can be sufficiently firmly held on the plate 12 until all six wires are in position. The cable holder and cover plate 12 complete with the six wires 80 can then be forced into mating engagement with the insulation displacement contacts 34 penetrating and contacting the conductors.

As the cable retaining slots 60 slope down from the surface 48 of the plate 12, the cable retention means does not get in the way when ribbon cable is being used, being below the plant of surface 48.

Figure 7:
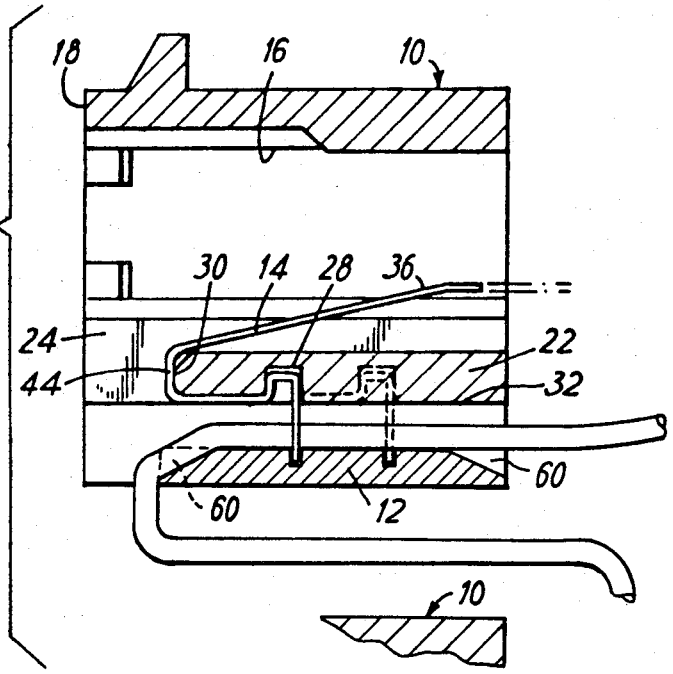
FIG. 7 is a view similar to FIG. 1 illustrating an alternative cable path.

In either event, whether ribbon cable or individual wires are used, the ends of the wires can be cropped along a cutting line defined by the front face 18 of the socket housing 10. However, the socket can alternatively be connected in line, that is to say to an existing length of cable, without cutting the cable. This is particularly convenient with a ribbon cable. In this case the cable is led away from the socket through the gap left between the front wall 56 of the cover plate 12 and the front face of the socket housing, as shown in FIG. 7. Using this technique, several sockets can be connected in parallel to the same cable, in a so-called daisy chain arrangement, and FIG. 7 indicates part of a second socket to which the cable can now be led.

The termination system is thus easy for a service engineer or installer to use in the field and does not need complex or expensive tooling. It is very quick and effective. Of course, the termination system can also be used to advantage in factory installation. The socket is very versatile, being usable with stranded wires or with ribbon cable without changing the form or type of connector.

On its exterior the housing 10 has several projections and grooves which enable the housing to be accommodated in a slot in a plate in two different possible orientations. A pair of grooves 82 running from back to front of the housing in its side walls allow the housing to be mounted in a plate with the direction of insertion of the plug in the socket being parallel to the plane of the plate. Projections 84 on the side walls define between them a gap 86 (see FIG. 2) for receiving a plate such that the direction of insertion of the plug is perpendicular to the plane of the plate. For further description of a housing permitting such alternative mounting positions reference should be made to our U.K. patent application No. 2,020,493A. The plate in which the housing is mounted can be a printed circuit board.

Figure 8:
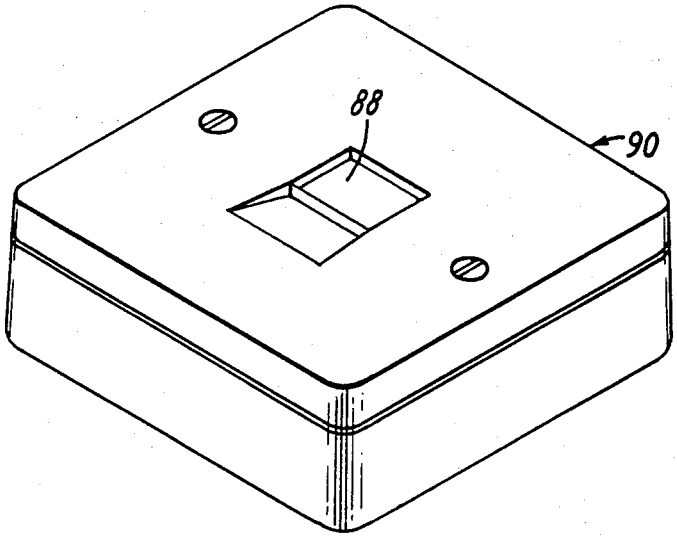
FIG. 8 shows a simple housing for the socket.
Figure 9:
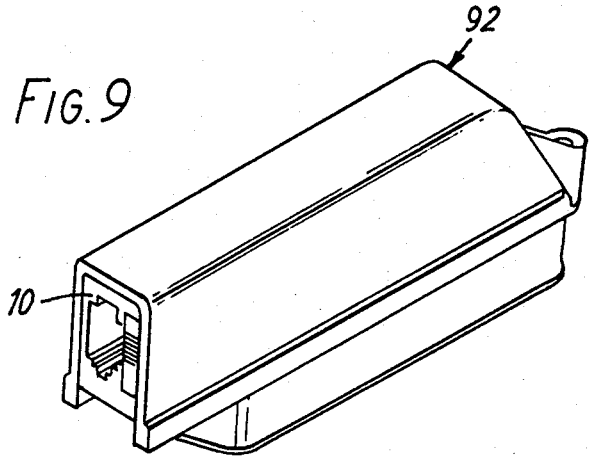
FIG. 9 shows the socket accommodated in a 50-way connector.

FIGS. 8 and 9 illustrate two typical uses of the socket. In FIG. 8 the socket is a single socket outlet in a surface mounted box 90 such as might be floor or wall mounted in a simple telephone system. The socket preferably has a sprung slidable cover plate 88 which is pushed sideways to permit a plug to enter the socket. Similar boxes can provide for multiple outlets, connected to different cables or (as in FIG. 7) to the same cable. FIG. 9 illustrates the use of the socket in conjunction with a 50-way connector 92. The socket is terminated onto flexible leads which are connected to selected ones of the pins of the 50-way connector. For further details of such a connector type, reference should be made to our U.S. Pat. No. 4,239,317.

FIG. 10 shows a plug 20 for use in the socket. The plug 20 is of generally rectangular section and naturally is shaped to conform with the internal dimensions of the socket 10. To this end the plug 20 is stepped at 102 and the portion of smaller cross-section, i.e. to the right of the step as seen in FIG. 10, is accommodated within the socket 10. The plug moulding includes a recess 104 which receives an aligning projection 106 in the socket 10. The plug 20 includes contact members 110 which are attached to respective conductors (not shown) by any suitable means and which are proud of the lower surface of the plug 20. Upon insertion of the plug 20 into the socket 10 the contacts 110 make sliding contact with the socket contacts 36.

The plug 20 is retrained in the socket against an accidental pull by a latching mechanism consisting of a lightly-sprung arm 112 integrally moulded with the plug and which has at least one notch 114. The notches engage with two projections 116 on the interior of the socket.

The action of sliding the plug into the socket progressively forces the latching arm 112 to lie closely against the side of the plug until the fully-inserted position is reached, whereupon the notches 114 and projections 116 line up and the arm 112 can spring outwardly with the projections 116 accommodated in the notches 114. The plug can be removed by grasping it between the thumb and forefinger so as to force the arm 112 to lie against the side of the plug whereupon the projections 116 and notches 114 disengage.

I claim:

1. A termination system for electrical conductors comprising:

a first insulative member including a wall member having a first surface, said first surface having recesses adjacent an edge of the wall member;

a plurality of conductive insulation—displacement contacts extending away from said first surface, each insulation displacement contact being provided at the first end portion of a respective contact member which is formed from a strip or sheet or conductive material, said contact member further comprising:

at a second end portion a flexible contact for making disconnectable sliding contact with another contact member of another connector member;

a first bent portion adjacent said first end portion and bent to be accommodated in a respective one of said recesses in said wall member; and a second bent portion between said first bent portion and said second end portion, said second bent portion being bent through an angle of between 90° and 180° and closely conforming around said edge of said wall member;

a second insulative member adapted to be opposed against said first surface on said first insulative member;

a second surface on said second insulative member and facing said first surface when said members are opposed to each other;

said first and second members being relatively moveable towards one another such that conductors located across said second surface on said second member can be forced into said insulation-displacement contacts on said first member; and means provided on said second member on opposed edge portions of said second surface and being capable of receiving, gripping and retaining conductors lying across said second surface prior to engagement with said contacts.

2. A system according to claim 1, including cooperating engagement means on said first and second members for retaining said members together.

3. A system according to claim 1, in which said second surface comprises a substantially planar surface and said receiving, gripping and retaining means are formed below the plane of said planar surface.

4. The system of claim 1 wherein said second bent portion of each contact is bent through an angle of between 135° and 180°.

5. The system of claim 1 wherein each of said contacts is stepped between its first and second end portions whereby the spacing between respective first end portions of said contacts is different than the spacing between respective second end portions of said contacts.

6. The system of claim 1 wherein said system comprises a telephone line jack.

7. A system according to claim 1, in which said receiving and retaining means are formed by slots in said second member, said slots being formed at an acute angle to said second surface.

8. A system according to claim 7, in which said slots are formed between upstanding ribs on said second member.

9. An electrical connector member having an insulative wall member with a recess on one surface thereof adjacent an edge of the wall member, and said connector member being provided with at least one resilient contact member, the or each said contact member being formed from a strip or sheet of conductive material and comprising:

at a first end portion an insulation displacement contact;

at a second end portion a flexible contact for making disconnectable sliding contact with another contact member of another connector member;

a first bent portion adjacent said first end portion and bent to be accommodated in said recess in said wall member; and a second bent portion between said first bent portion and said second end portion, said second bent portion being bent through an angle of between 90° and 180° and closely conforming around said edge of said wall member;

whereby said contact member is retained on said wall member by resilient gripping action between said first and second bent portions.

10. Apparatus according to claim 9, in which the recesses in the first surface are box shaped recesses, and the first bent portion comprises a substantially box-shaped section.

11. The connector member of claim 9 wherein said connector member comprises a telephone line jack.

12. The connector member of claim 9 including a plurality of said contact members.

13. The connector member of claim 12 wherein said second bent portion of each contact member is bent at an angle of between 135° and 180°.

* * * * *